United States Patent [19]

Fedick et al.

[11] Patent Number: 4,583,639

[45] Date of Patent: Apr. 22, 1986

[54] PACKAGED REPLACEMENT WINDOW

[76] Inventors: John Fedick, 24 Saddleback Trail, Rochester, N.Y. 14624; Francis J. Schweitzer, Jr., 14 Sandy Cove, Clover, S.C. 29710

[21] Appl. No.: 708,490

[22] Filed: Mar. 5, 1985

Related U.S. Application Data

[63] Continuation-in-part of Ser. No. 211,475, Nov. 28, 1980, abandoned, and Ser. No. 229,966, Jan. 30, 1981, abandoned.

[51] Int. Cl.[4] ..... B65D 85/30

[52] U.S. Cl. ..... 206/325; 49/445; 49/455; 206/454; 206/577; 206/586

[58] Field of Search ..... 206/223, 321, 325, 454, 206/577, 586; 49/380, 445, 446, 447, 453–457, 504, 505; 52/204, 217

[56] References Cited

U.S. PATENT DOCUMENTS

| | | | |
|---|---|---|---|
| 954,606 | 4/1910 | Baker | 49/457 |
| 1,050,924 | 1/1913 | Dowd | 49/505 |
| 1,285,269 | 11/1918 | Lunken | 206/325 |
| 1,766,317 | 6/1930 | Wheless | 206/577 |
| 1,964,332 | 6/1934 | Rembaum | 49/380 |
| 2,489,029 | 11/1949 | Guerrant | 206/60 |
| 2,742,146 | 4/1956 | Lester, Jr. | 206/60 |
| 2,746,667 | 5/1956 | Murphy | 229/14 |
| 2,853,161 | 9/1958 | Mascari | 49/505 |
| 2,896,833 | 7/1959 | Markham | 229/14 |
| 3,050,234 | 8/1962 | Salmon | 229/51 |
| 3,079,986 | 3/1963 | Ford | 206/577 |
| 3,111,724 | 11/1963 | Piekarski | 206/325 |
| 3,122,798 | 3/1964 | Zegers et al. | 49/380 |
| 3,149,664 | 9/1964 | Keating | 206/577 |
| 3,482,354 | 12/1969 | Trout | 49/446 |
| 3,928,953 | 12/1975 | Mazzoni et al. | 52/172 |
| 3,939,978 | 2/1976 | Thomaswick | 206/454 |
| 3,981,103 | 9/1976 | McAllister | 49/505 |
| 4,067,157 | 1/1978 | Robinson | 49/504 |
| 4,241,540 | 12/1980 | Depperman | 206/321 |

FOREIGN PATENT DOCUMENTS

| | | | |
|---|---|---|---|
| 2560 | 6/1890 | United Kingdom | 49/456 |

*Primary Examiner*—William Price
*Assistant Examiner*—Gary E. Elkins

[57] ABSTRACT

A packaged replacement window includes a rectangular carton and two wood window sash, one overlying the other, within the carton. In addition, the packaged window includes two jamb weatherstrip and balance assemblies which are folded intermediate their ends and lie along the side walls of the carton outwardly from the side edges of the sash. The jamb weatherstrip and balance assemblies when removed from the carton will open to a straight condition, and in that condition the jamb weatherstrip and balance assemblies may be installed along the sides of a window opening where the sash may be engaged with them. A lid fits over the carton to completely enclose the sash and the jamb weatherstrip and balance assemblies that are within the carton. All the components necessary to install the replacement window are contained within the package which is easily stored, transported, and otherwise handled.

15 Claims, 8 Drawing Figures

PACKAGED REPLACEMENT WINDOW

This application is a continuation-in-part of application Ser. No. 211,475, filed Nov. 28, 1980, now abandoned, entitled PRE-ASSEMBLED WINDOW, and application Ser. No. 229,966, filed Jan. 30, 1981, now abandoned, entitled PACKAGED REPLACEMENT WINDOW.

BACKGROUND OF THE INVENTION

This invention relates in general to replacement windows for buildings, and more particularly to a packaged replacement window that is easily stored, transported, and otherwise handled.

The windows in buildings usually deteriorate with age, and the effects of deterioration not only lead to an unsightly appearance, but further contribute significantly to the loss of heat. Furthermore, double hung windows were for many years manufactured with counterweights to maintain the sash at the desired height, but sash chains or cords in time break, leaving the counterweights of many early windows isolated and inaccessible in cavities along the sides of their window frames.

The traditional approach for remedying the problems produced by an old and inoperative window has been to remove the entire window unit and replace it with an entirely new window unit. This procedure usually creates a considerable mess and leaves both the interior and exterior wall surfaces of the building marred, for the window frame must be removed from the wall in which it is embedded. Hence, the replacement of a window is usually accompanied by the application of some plaster and is almost always followed by painting.

To reduce the cost and other inconveniences of window replacements, some window manufacturers now market replacement windows for installation in existing window frames. Thus, the frame remains in the wall and the surrounding plaster or other surface material is not disturbed. The typical double hung replacement window of this type basically consists of two jamb weatherstrip and balance assemblies which extend the full height of the window opening at each side, and sash which fit into the assemblies and close the opening. The sash slide upwardly and downwardly in the old window frame, yet seal it much more effectively than the old sash because of better weather stripping. Moreover, most of the sash have insulating overlying glass which significantly reduce the heat loss and the condensation problems associated with single panes of glass.

While the new replacement windows, that is the ones designed for installation in existing frames, offer many advantages over the traditional approach to window replacement, there are some disadvantages which are particularly troublesome to suppliers such as lumber yards and other building supply outlets. In contrast to conventional windows which are sold as units, that is with the sash and frame all joined together in a single unit, the sash and weatherstrip assemblies of the new replacement windows are generally separate and are not packaged together because the weatherstrip assemblies are so much longer than the sash. Normally the weatherstrip assemblies are stored separately from the sash and as a result they are sometimes lost or else sold with the wrong sash. This makes the inventory difficult to control. Also, the sash lay about where they might become damaged, often being kicked or nicked by hard tired trucks. Aside from that, the presence of the long weatherstrip assemblies makes transporation of the replacement windows difficult, particularly for the ultimate purchaser who often has nothing more than an automobile to transport the relatively long jamb weatherstrip and balance assemblies.

SUMMARY OF THE INVENTION

One of the principal objects of the present invention is to provide a packaged replacement window that is easily stored and transported. Another object is to provide a replacement window of the type stated that includes sash and elongated jamb weatherstrip and balance assemblies, the latter of which are folded intermediate their ends and fitted along the side walls of a carton where they bend around the corners of the sash which are stacked one upon the other in the carton. A further object is to provide a packaged replacement window of the type stated that is contained within a carton that can be easily stored, handled, and transported. An additional object is to provide a packaged replacement window of the type stated that has substantial columnar strength so that a large number of the packaged replacement windows can be stored in a single stack. Still another object is to provide a replacement window of the type stated that is easily removed from its packaging and installed in the opening of an existing window frame.

The present invention is embodied in a packaged replacement window including a carton, a sash within the carton, and jamb weatherstrip and balance assemblies that are segmented with the sections thereof lying along the edges of the sash. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur—

DETAILED DESCRIPTION

Figure 1:
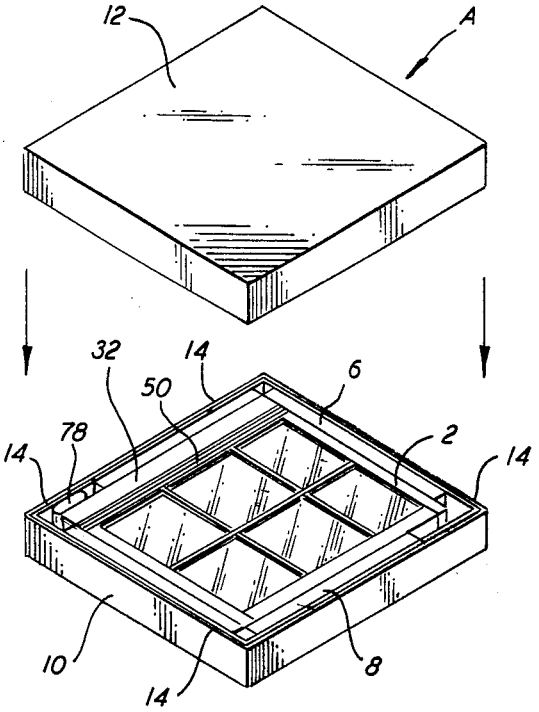
FIG. 1 is a perspective view showing the packaged replacement window of the present invention with the lid removed from the carton to show the window components within the carton.

Referring now to the drawings, a packaged replacement window A (FIGS. 1 and 2) has window components and packaging components. The window components essentially comprise upper and lower sash 2 and 4 and left and right jamb weatherstrip and balance assemblies 6 and 8. The jamb weatherstrip and balance assemblies 6 and 8 are designed to fit along the sides of a window opening, such as the opening in an existing window frame, and provide a slideway for the sash 2 and 4. The sash 2 and 4, on the other hand, are designed to engage assemblies 6 and 8 along their side edges so that each can move upwardly and downwardly independently of the other and thereby provide a double hung window arrangement. The packaging components of the packaged replacement window A essentially comprise a relatively shallow carton 10 of rectangular configuration which is large enough to receive the sash 2 and 4, a lid 12 that fits over and closes the carton 10, corner pieces 14 located within the carton 10 at its corners, and a separator 16 that fits between the two sash 2 and 4 within the carton 10. The window components are contained entirely within the carton 10 and as a consequence the packaged window A is easily stored, handled, and transported.

Considering the carton 10 first, it is preferably formed from corrugated paper with a flat bottom wall 22 (FIG. 2) that is rectangular, it being slightly longer and wider than each of the sash 2 and 4. In addition, the carton 10 has four side walls 24 which extend upwardly from the bottom wall 12 and are joined together at their ends to form the corners of the carton 10. In this regard, two of the side walls 24 are provided at their ends with flaps 26 that turn inwardly and lie along the other side walls 24 to which they are secured by staples or glue.

The lid 12 (FIG. 2) is very similar to the carton 10, it having a top wall 28 that is slightly longer and wider than the carton bottom wall 22 and side walls 30 that extend downwardly from the top wall 28 and are joined together at their ends to form the corners of the lid 12. The lid 12 fits over the carton 10 with its side walls 30 being located immediately outwardly from the carton side walls 24. When the lid 12 is so disposed, its top wall 28 closes the otherwise open top of the carton 10.

The corner pieces 14 (FIG. 2) are nothing more than strips of corrugated paper that are about the same height as the carton side walls 24. Midway between its ends, each corner piece 14 is folded to a right angle, and then fitted into a corner of the carton 10. Thus, each of the four corners of the carton 10 is reinforced with a corner piece 14.

The separator 16 (FIG. 2) is also formed from corrugated paper and is the same size as the sash 2 and 4, so that it fits between the sash 2 and 4 when they are stacked together in the carton 10. However, the separator 16 may be slightly longer than the sash 2 and 4 are high so that it can extend beyond one end of the stacked together sash 2 and 4. Here the separator 16 may be folded into a somewhat rectangular filler section 32 which is used to adapt the carton 10 to sash 2 and 4 that are somewhat smaller than the maximum size for which the carton 10 is designed.

The sash 2 and 4 are the same width, but as is typical with double hung windows, the lower sash 4 is slightly taller than the upper sash 2. Each sash 2 and 4 has a rectangular frame 40 (FIG. 2) made from wood and preferably two lights 42 of glass, with one located in front of the other such that a slight air space exists between them to provide good insulating properties. Along its sides the frame 40 of each sash 2 and 4 has a groove 44 and at the lower end of each groove 44 the frame 40 is provided with a metal pivot pin 46 which projects laterally out of the groove 40 and beyond the side edge of the frame 40. In addition, each sash 2 and 4 may be fitted with a grill or mullions 48 which snap into its frame 40 against the inner of the two lights 42 of glass. The mullions 48 impart a more traditional appearance to the sash 2 or 4 by simulating panes of glass. Nevertheless, they do not project beyond the inner surface of the side and bottom members for the sash frame 40. In this regard, the horizontal and vertical members of the frame 40 for the lower sash 4 are all the same thickness and therefore the inside surfaces of all four members lie in the same plane and likewise so do the outside surfaces. The same holds true for the upper horizontal member and vertical members for the upper sash 2. However, the lower horizontal member on the upper sash 2 is somewhat thicker. While the outer surface of this member is flush with the outer surface on the remaining members of the upper sash frame 40, the inner surface of the lower horizontal member is set inwardly from the inner surfaces of the remaining members, and the inwardly directed portion is provided with a thin flexible weatherstrip 50 which is designed to contact the upper member of the lower sash frame when the sash 2 and 4 are in their respective closed positions on the jamb assemblies 6 and 8, thus forming an effective weather seal between the two sash 2 and 4.

The two sash 2 and 4 fit within the carton 10, with the lower sash 4 against the carton bottom wall 22 and the upper sash 2 resting on the lower sash 4, its weatherstrip 50 being presented upwardly (FIG. 1). The separator 16 is interposed between the two stacked together sash 2 and 4 to prevent one from marring the other. Since the upper sash 2 is oriented such that the projecting portion of its upper horizontal member is directed upwardly, the frames 40 of the two sash 2 and 4 rest perfectly flat against the separator 16 and neither sash is subjected to any distorting forces. In other words, the lower sash 4 presents a perfectly flat or planar surface of its frame 40 toward the bottom wall of the carton 10 as well as toward the separator 16. Similarly, the upper sash 2 presents a perfectly flat or planar surface of its frame 40 toward the separator 16.

Figure 6:
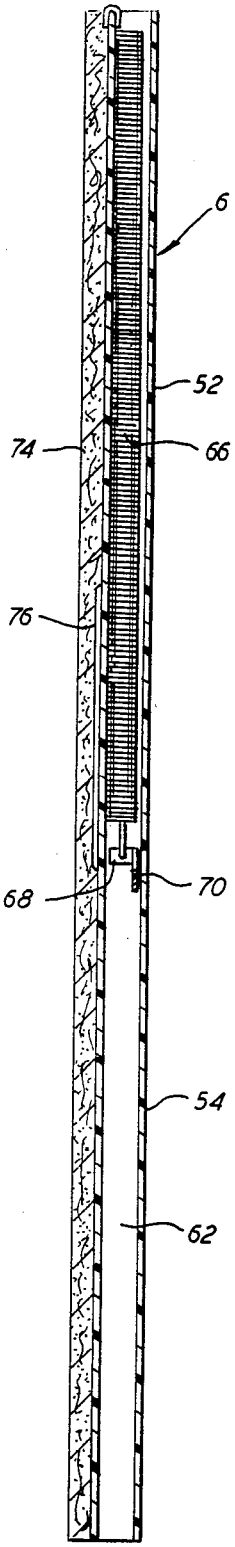
FIG. 6 is a sectional view of the jamb assembly taken along line 6—6 of FIG. 3.
Figure 7:
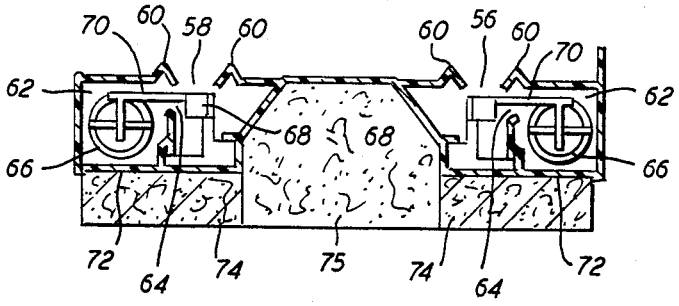
FIG. 7 is a cross-sectional view of the jamb assembly taken along line 7—7 of FIG. 3.

Each jamb weatherstrip and balance assembly 6 and 8 has upper and lower sections 52 and 54, respectively, which are preferably plastic extrusions of identical cross-sectional configuration (FIGS. 3–7). Each jamb assembly 6 and 8 is partially slit or cut such that it may be folded away from a condition of alignment in which the upper section 52 forms a straight continuation of the lower section 54. Each section 52 and 54 includes rear and front grooves 56 and 58 (FIGS. 3 and 7) which are spaced apart and parallel and are large enough to receive the pivot pins 46 that extend from the side edges for the frames 40 of the upper and lower sash 2 and 4. Along both sides of each groove 56 and 58 are guide ribs 60 (FIG. 7) which project slightly from the main body of the jamb assembly 6 or 8. The two ribs 60 along the rear grooves 56 for the two assemblies 6 and 8 are configured to fit the grooves 44 along the sides of the upper sash frame 40, whereas the ribs 60 along the front grooves 58 are configured to fit the grooves 44 of the lower sash frame 40. To the side of each groove 56 and 58 is a channel 62 which opens into its respective groove 56 or 58 through a slot 64. Each channel 62 contains a coil type tension spring 66, the upper end of which is looped over and hooked onto the upper end of the upper section 52, while the lower end is connected to a slide 68 having an arm 70 that extends through the slot 64 where it engages the lower end of the spring 62 in the adjoining channel 62 (FIGS. 6 and 7).

Figure 8:
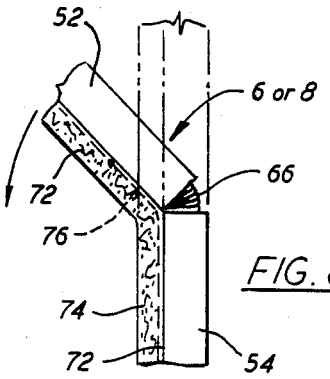
FIG. 8 is a fragmentary side elevational view of the jamb assembly showing it folding to the position in which it is contained within the carton of the package.

Behind its channel 62 each section 52 and 54 has a flat surface 72 (FIGS. 5 and 6) to which a foam type weatherstrip 74 is attached by a suitable adhesive. Also, between the two weatherstrips 74 are pads 75 of the same material, there being one pad 75 at the free end of the upper section 52, another at the free end of the lower section 54, and still another at the hinge connection between the two sections 52 and 54. The partial slit or cut that separates the two sections 52 and 54 does not exist along the walls on which the flat surfaces 72 lie, but here the joint between the upper and lower sections 52 and 54 is bridged by a fiber-reinforced tape 74 which is applied to the two flat surfaces 72 underneath the weatherstrip 74 on those surfaces. The tape 76, by serving as a reinforcement, enables the two sections 52 and 54 to be folded from the condition of alignment to an angular disposition wherein they are at a 90° angle with respect to each other (FIG. 8). Normally, the slides 68 are within the lower section 54 and are cocked as a result of the force exerted on them by their springs 66. This causes the slides 68 to lodge in their respective grooves 56 and 58. As a consequence, the springs 66 span the joint between the two sections 52 and 54. Even so, the springs 66 do not prevent the sections 52 and 54 from folding with respect to each other, for they merely flex at the joint. The springs 66, however, being under some tension, do urge the sections 52 and 54 to the aligned condition in which the upper section 52 forms a straight line continuation of the lower section 54. When so disposed, the grooves 56 and 58, the slots 64, and the channels 62 of the two sections 52 and 54 are perfectly aligned so that the springs 66 can contract and expand without interference.

Figure 2:
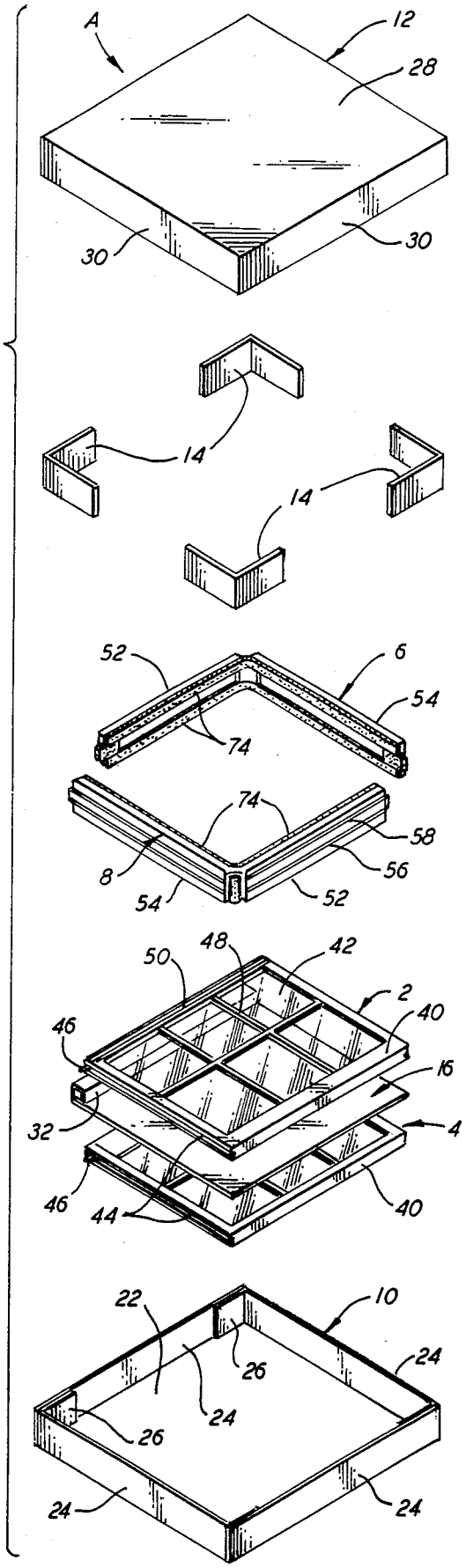
FIG. 2 is an exploded perspective view of the packaged replacement window showing both the window and packaging components.
Figure 3:
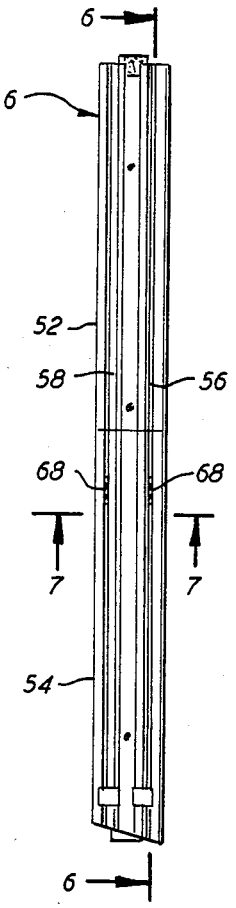
FIG. 3 is a front elevational view of one of the jamb weatherstrip and balance assemblies showing the face thereof along which the sash slide.
Figure 4:
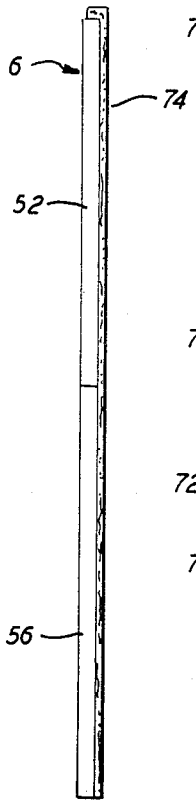
FIG. 4 is a side elevational view of the jamb assembly.
Figure 5:
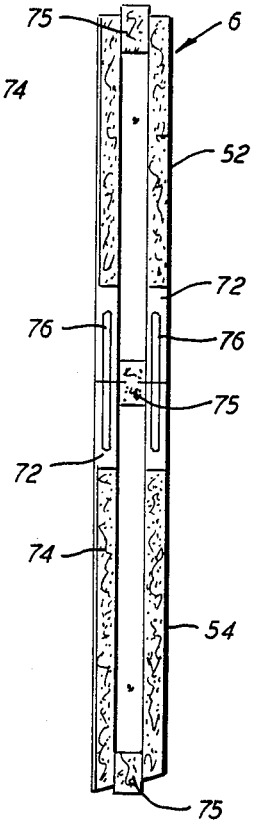
FIG. 5 is a rear elevational view of the jamb assembly.

The left and right jamb assemblies 6 and 8 also fit within the carton 10, but must be folded into the right angle position. More specifically, the left jamb assembly 6 is folded to a right angle position and then positioned with each of its sections 52 and 54 along adjacent side walls 24 of the carton 10, in which case the assembly 6 fits around one of the corners for the stacked together sash 2 and 4 (FIGS. 1 and 2). Indeed, the sections 52 and 54 lie opposite to the edges of the sash 2 and 4, with their soft weatherstrip 74 presented toward those edges. The right jamb assembly 8 is likewise folded to a 90° angle and positioned along the other two walls of the carton 10, in which case it fits around the diagonally opposite corner of the stacked together sash 2 and 4.

The corner pieces 14 for the carton 10 are disposed outwardly from the jamb assemblies 6 and 8 (FIG. 1), and the ones at the corners which are not occupied by hinge joints of the sash guides 6 and 8 are long enough to lap over the nearby ends of the jamb assemblies 6 and 8. Since the weatherstrips 74 for the jamb assemblies 6 and 8 are presented inwardly toward the frames 40 of the sash 2 and 4, the sash frames 40 are protected and are certainly not in any way marred by the harder plastic material of the sash guides 6 and 8. The opposite surfaces of the jamb assemblies 6 and 8, on the other hand, are spaced slightly inwardly from the side walls 24 of the carton 10 by the corner pieces 14 so that they are less likely to be damaged. Even so, the jamb assemblies 6 and 8, being formed from a flexible plastic, are likely to yield or flex rather than crack if the side wall of the carton 10 is subjected to a sharp impact.

The width of the jamb assemblies 6 and 8 is slightly greater than the combined thickness of the two sash 2 and 4 that are stacked within the carton 10, and as a consequence, the jamb assemblies 6 and 8 give the carton a measure of columnar strength, particularly along its side walls 24 where it is needed most. In this regard, the jamb assemblies 6 and 8 are somewhat narrower in width than the side walls 24 of the carton 10 and the corner pieces 14 which provide the initial columnar strength to the carton 10. However, if the carton 10 is subjected to extremely heavy loading, the jamb assemblies 6 and 8, being placed around the sash 2 and 4, will take that loading in the direction in which they are perhaps the strongest, that is the transverse direction. As a consequence, quite a few of the packaged replacement windows A may be stacked one upon the other in a warehouse or building supply outlet.

Finally, the packaged window unit includes a bag 78 (FIG. 1) containing hardware such as a sash lift, a sash lock, and the necessary screws for securing the jamb assemblies 6 and 8 to an existing window frame, and this bag 78 fits in one of the corners located beyond the ends of two of the sash guides 6 and 8.

Should the carton 10 be somewhat longer than the length of the sash 2 and 4 and the combined width of the jamb assemblies 6 and 8, the additional space may be filled by providing the separator 16 with a filler section 32 (FIG. 1). In this instance, the filler section 32 prevents the sash 2 and 4 from moving around within the carton 10 and perhaps damaging the jamb assemblies 6 and 8 or marring the wood sash frames 40.

The packaged replacement window A is sold as such, that is with the entire replacement window contained within the carton 10 and the lid 12 that fits over the carton 10. Thus, the replacement window A is conveniently stored and also conveniently handled and transported.

To install the replacement window A in an existing window frame, the original sash are removed from the frame along with stops, perhaps some of the trim, and the existing jamb assemblies. Then, the left and right jamb assemblies 6 and 8 are removed from the carton 10 and allowed to open to their aligned positions. The jamb weatherstrip and balance assemblies 6 and 8 are then attached to the sides of the window frame such that the grooves 56 and 58 of the left lamb assembly 6 open toward the grooves 56 and 58 of the right jamb assembly 8. This is achieved merely by inserting simple wood screws through the jamb assemblies 6 and 8 and driving them into the sides of the window frame. With the jamb assemblies 6 and 8 so positioned, the soft weatherstrip 74 conforms to any irregularities in the sides of the window frame and forms a weather-tight seal. Next the pivot pins 46 of the upper sash 2 are fitted into the rear grooves 56 of the two jamb assemblies 6 and 8, while the sash 2 is held at a steep angle with respect to the jamb assemblies 6 and 8. The pins 46 engage the slides 68 within the grooves 56, causing the slides 68 to straighten and no longer bind within the grooves 56. The upper sash 2 is then pivoted forwardly toward the window opening and forced through the assemblies which flex to accommodate the sash 2. Indeed, the sash 2 is moved forwardly until the ribs 60 along the rear grooves 56 snap into the grooves 44 along the sides of the frame 40 for the upper sash 2. The spring 66 in the rear channels 62 of the jamb assemblies 6 and 8, being engaged with the upper sash 2 through the slides 68 and pivot pins 46, urges the upper sash 2 through the slides 68 and pivot pins 46, urges the upper sash 2 upwardly. Once the upper sash 2 is installed, the pivot pins 46 for the lower sash 4 are fitted into the front grooves 58 on the jamb assemblies 6 and 8 and are engaged with the slides 68 in those grooves 58, whereupon the lower sash 4 is swung forwardly and forced into the jamb assemblies 6 and 8 which flex to accommodate the lower sash 4. The ribs 60 along the front grooves 58 of the jamb assemblies 6 and 8 snap into the grooves 44 in the sides of the lower sash frame 40 and thereby confine the lower sash 4 in the horizontal direction, yet enable the sash 2 and 4 to slide upwardly and downwardly. The springs 66 in the front channel 62 urge the lower sash 4 upwardly.

In lieu of a one-piece jamb weatherstrip and balance assembly which can be bent, the jamb weatherstrip and balance assembly may be supplied in two pieces or segments which upon installation fit together. These segments lie along the side edges of the sash in the carton 10.

This invention is intended to cover all changes and modifications of the example of the invention herein chosen for purposes of the disclosure which do not constitute departures from the spirit and scope of the invention.

What is claimed is:

1. A packaged replacement window comprising: a carton; at least one pair of window sash in the carton with one sash of the pair overlying the other sash of the pair, the sash being adapted to close a window opening; and jamb assemblies in the carton and being adapted for installation along the sides of the window opening to hold the sash in the opening, each jamb assembly being segmented intermediate its ends into sections which lie along the edges of the sash, the jamb assemblies being at least as deep as the combined thicknesses of the two sash and being disposed within the carton such that a deeper face on each is presented opposite to the side edge of the sash, whereby the jamb assemblies provide columnar strength along the sides of the carton.

2. A packaged replacement window comprising: a carton having a rectangular bottom wall and four side walls extending upwardly from the bottom wall to surround an enclosed space, first and second window sash located within the enclosed space, with one sash overlying the other sash such that at least the side edges of the two sash are generally in registration, the sash being adapted to close a window opening; left and right jamb assemblies, the lengths of which are substantially greater than the height of either of the sash, each jamb assembly being bent to a generally 90 degree configuration so that the jamb assembly has one section on one side of the bend, the sections being of generally the same cross-sectional configuration and the bend being such that the sections on each side of it can be folded between a position in which they align and an angular position in which they are disposed generally at right angles with respect to each other, each jamb assembly being disposed within the carton in its folded condition with one section thereof being located along one carton side wall and the other section along an adjoining carton side wall and the right angle bend being located generally at the corner where the two side walls along which the sections lie are joined together, the jamb assemblies when in their aligned position being adapted to engage the sash at the edges of the sash so as to hold the sash in a window opening, while nevertheless permitting the sash to slide upwardly and downwardly in the opening.

3. A replacement window according to claim 2 wherein the 90 degree bends of the jamb assemblies are located at diagonally opposite corners of the carton and each of the four side edges of the sash lie with a portion of a jamb assembly extending along it.

4. A replacement window according to claim 2 wherein each jamb assembly, when its sections move into alignment, folds away from the face on it at which it is designed to engage the sash so that those faces are presented toward the side walls of the carton.

5. A replacement window according to claim 4 whereing the jamb assemblies have a soft flexible weatherstrip material along the faces thereof that are presented away from the side edges of the sash when the sash is operatively engaged with the jamb assemblies and within the carton the weatherstrip material is presented toward the side edges of the dash to cushion those edges in the event that the sash is thrust into the jamb assenmblies within the carton.

6. A replacement window according to claim 3 and further comprising four corner pieces located in the carton at the corners thereof outwardly from the sash and folded jamb assemblies that are within the carton, two of the corner pieces being located directly outwardly from the folds in the jamb assemblies and the remaining two corner pieces being long enough to overlap the free ends of the jamb assemblies.

7. A packaged replacement window comprising: a carton having four side walls defining a rectangular space; at least two rectangular window sash contained entirely within and being only slightly smaller than the rectangular space in the carton, the sash being adapted to fit into a window opening; and two jamb assemblies also contained within the carton and being configured to engage the sash along opposite edges of the sash, each jamb assembly being segmented into a least two sections with each section being small enough to fit entirely within the carton along with the sash, the sections when removerd from the carton being adapted to align and to further fit along the side of the window opening to engage the sash and hold the sash in the opening, the jamb assembly when its sections are aligned being too long to fit within the carton.

8. A packaged replacement window according to claim 7 wherein the sections of the jamb assemblies lie between the side edges of the sash and the side walls of the carton.

9. A packaged replacement window according to claim 7 wherein the two sections of each jamb assembly are connected at a hinge joint and the jamb assemblies are bent at about 90 degrees within the carton, with one section being along one edge of the sash, another along an intersecting edge of the sash, and the hinge joint being located at the intersection of the two edges of the sash.

10. A packaged replacement window comprising: a carton; at least one pair of window sash in the carton and being adapted to close a window opening; and jamb assemblies in the carton and being adapted for installation along the sides of the window opening to hold the sash in the opening, each jamb assembly being segmented intermediate its ends into sections which are disposed at right angles with respect to each other in the carton and lie along the edges of the sash in the carton, the jamb assemblies being deeper than they are wide and further being disposed within the carton such that one of the deeper faces of each is presented opposite to an edge of the sash.

11. A packaged replacement window comprising: a carton; at least one pair of window sash in the carton and being adapted to close a window opening; and jamb assemblies in the carton and being adapted for installation along the sides of the window opening to hold the sash in the opening, each jamb assembly being segmented intermediate its ends into sections which lie along the edges of the sash, with the sections being joined together at a cut which forms a hinge where the assembly is bent at about 90 degrees, the hinge and 90 degree bend being located opposite a corner of the sash, each jamb assembly further comprising coil type balance springs, with the springs spanning the 90 degree bend between the two sections of each jamb assembly and tending to urge the sections into straight alignment.

12. A packaged replacement window comprising: a carton; at least one pair of window sash in the carton and being adapted to close a window opening; and jamb assemblies in the carton and being adapted for installation along the sides of the window opening to hold the sash, each jamb assembly being segmented intermediate its ends into sections which lie along the edges of the sash, the sections of each jamb assembly being joined together in end-to-end abutment at a hinge joint where the jamb assembly is bent at about 90 degrees in the carton, the bend being reinforced by tape which spans the bend and attaches to the sections beyond the bend, thereby enabling the jamb assembly, when removed from the carton, to fold from the bent condition to a straight condition in which the sections are in alignment.

13. A packaged replacement window comprising: a carton; at least one pair of window sash in the carton with one sash of the pair overlying the other sash of the pair, the sash being adapted to close a window opening; and jamb assemblies in the carton and being adapted for installation along the sides of the window opening to hold the sash in the opening, each jamb assembly being segmented intermediate its ends into sections which lie along the edges of the sash, the jamb assemblies being at least as deep as the combined thickness of the two sash and being disposed within the carton such that a deeper face on each is presented oposite to a side edge of the sash, whereby the jamb assemblies provide columnar strength along the sides of the carton.

14. A packaged window according to claim 7 wherein each section of the two jamb assemblies lies along a different edge of the sash within the carton so that each of the four edges of the sash has a jamb assembly section along it.

15. A packaged window according to claim 8 and further comprising corner pieces located in the corners of the carton outwardly from the sash and jamb assembly within the carton.

* * * * *